US006381817B1

(12) United States Patent
Moody, III

(10) Patent No.: US 6,381,817 B1
(45) Date of Patent: May 7, 2002

(54) COMPOSITE NONWOVEN FABRIC

(75) Inventor: Ralph A. Moody, III, Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/815,527

(22) Filed: Mar. 23, 2001

(51) Int. Cl.[7] ..... D04H 13/00
(52) U.S. Cl. ..... 28/104; 442/408
(58) Field of Search ..... 28/103, 104, 105, 28/106, 107, 116, 117, 158, 167; 442/384, 389, 385, 408, 394, 416; 428/137, 297.4, 300.7

(56) References Cited

U.S. PATENT DOCUMENTS 4,475,271 A 10/1984 Lovgren et al.
4,902,564 A * 2/1990 Israel et al. ..... 28/104
5,007,137 A 4/1991 Graute
5,253,397 A * 10/1993 Neveu et al. ..... 28/105
5,459,912 A 10/1995 Oathout
5,573,841 A * 11/1996 Adam et al. ..... 28/105
5,618,610 A * 4/1997 Tomita et al. ..... 28/104
5,759,929 A * 6/1998 Ikezawa et al. ..... 442/385
5,780,369 A * 7/1998 Allison et al. ..... 442/384
6,022,818 A * 2/2000 Welchel et al. ..... 442/384
6,314,627 B1 * 11/2001 Ngai ..... 28/104

* cited by examiner

*Primary Examiner*—Amy B. Vanatta
(74) *Attorney, Agent, or Firm*—Rockey, Milnamow & Katz, Ltd.

(57) ABSTRACT

A composite nonwoven fabric is formed by providing a synthetic fiber web comprising staple length polymeric fibers, and a cellulosic fiber web, preferably comprising wood pulp fibers. Prior to integration of the webs, the synthetic fiber web is subjected to hydroentangling to form a partially entangled web, with the cellulosic fiber web thereafter juxtaposed with the partially entangled web for hydroentanglement and integration of the webs. Pre-entanglement of the synthetic fiber web desirably acts to minimize the energy input required for integration of the cellulosic fiber and synthetic fiber webs, and also desirably acts to abate loss of the cellulosic fibers during hydroentanglement and integration of the webs.

10 Claims, 1 Drawing Sheet

COMPOSITE NONWOVEN FABRIC

TECHNICAL FIELD

The present invention relates generally to hydroentangled (spunlaced) nonwoven fabrics, and more particularly to a hydroentangled composite nonwoven fabric formed from a synthetic fiber web and a cellulosic fiber web, which webs are integrated so that the cellulosic fibers become integrated with the synthetic fiber structure. The resultant fabric exhibits excellent strength and absorbency, and is particularly suited for use in medical gowns, and like applications.

BACKGROUND OF THE INVENTION

Nonwoven fabrics have found widespread application by virtue of the versatility afforded by the manner in which the physical characteristics of such fabrics can be selectively engineered. Formation of nonwoven fabrics by hydroentanglement (spunlacing) is particularly advantageous in that the fibers or filaments from which the fabric is formed can be efficiently integrated and oriented as may be desired for a specific application. Blends of different types of fibers can be readily combined by hydroentanglement so that resultant fabrics exhibiting selected physical properties can be fabricated.

Heretofore, nonwoven fabrics formed from blends of synthetic and cellulosic fibers have been known, with such fabrics desirably exhibiting physical properties which are characteristic of the constituent synthetic and cellulosic fibers. Typically, synthetic fibers can be formed into a fabric so that the characteristics such as good abrasion resistance and tensile strength can be provided in the resultant fabric. The use of cellulosic fibers provides such fabrics with desired absorbency and softness.

U.S. Pat. No. 5,459,912, to Oathout, hereby incorporated by reference, discloses patterned, spunlaced fabrics formed from synthetic fibers and wood pulp which are stated as exhibiting good absorbency, and low particle counts. The fabrics are thus suited for use where these characteristics are desirable, such as for use as wipes in clean rooms, wipes for food service, and like applications. However, this patent contemplates integration of wood pulp fibers and synthetic fibers in a dry state, with subsequent hydroentanglement by treatment on one side only. It is believed that this results in significant loss of the wood pulp fibrous material through the loosely bonded synthetic fibers, thus detracting from the efficiency of the manufacturing process.

Because composite nonwoven fabric materials formed from synthetic and cellulosic fibers can provide a combination of desirable physical properties, the present invention is directed to a method of making such a composite nonwoven fabric which facilitates efficient fabric formation by abating loss of cellulosic fibers to the filtrate water during integration by hydroentanglement.

SUMMARY OF THE INVENTION

The present invention is directed to a method of making a composite nonwoven fabric which entails integration of a staple length synthetic fiber web with a web of cellulosic fiber material, typically wood pulp. In order to abate loss of cellulosic fiber material during integration by hydroentanglement, the present invention contemplates that the synthetic fiber web is first subjected to hydroentanglement, with the cellulosic fibrous material thereafter integrated, by hydroentangling, into the partially entangled synthetic fiber web. This formation technique has been found to desirably abate the loss of the cellulosic fibers during the hydroentangling process into the filtrate water employed for hydroentanglement. The resultant fabric exhibits the desired blend of characteristics achieved by use of the synthetic and cellulosic fibers together, with the manufacturing technique of the present invention desirably facilitating efficient and cost-effective formation of the present fabric.

In accordance with the present invention, a method of making a composite nonwoven fabric comprises the steps of providing a synthetic fiber web comprising staple length polymeric fibers. Use of polyester (PET) fibers is presently preferred by virtue of the economy with which such fibers can be manufactured and processed. The present process further comprises hydroentangling the synthetic fiber web to form a partially entangled web. This partial hydroentanglement desirably acts to integrate the staple length synthetic fibers, prior to introduction of the associated cellulosic fibrous material.

The cellulosic fibrous material of the present fabric is introduced by juxtaposing a cellulosic fibrous web with the partially entangled synthetic fiber web. The juxtaposed webs are then hydroentangled, and subsequently dried to form the present composite nonwoven fabric. Notably, the pre-entanglement of the synthetic fiber web, prior to introduction of the cellulosic fibrous material, has been found to desirably minimize loss of the cellulosic material as the synthetic and cellulosic webs are integrated by hydroentanglement. It is believed that the pre-entangled synthetic fiber web may desirably act to "filter" the cellulosic fibrous material, so as to minimize its loss to the filtrate water. Additionally, pre-entanglement of the synthetic fiber web desirably permits the use of reduced energy input for entangling the synthetic and cellulosic fiber webs, which is also believed to contribute to reduced loss of the cellulosic fibers. It is also believed that the ability to employ reduced energy input for entangling the component webs allows for maintaining the inherent bulk of the composite nonwoven fabric, and thus allowing for improved absorbency with the increase in interstitial volume over a high-pressure hydroentangled nonwoven fabric.

Other features and advantages of the present invention will become readily apparent from the following detailed description, the accompanying drawing, and the appended claims.

DETAILED DESCRIPTION

Figure 1:
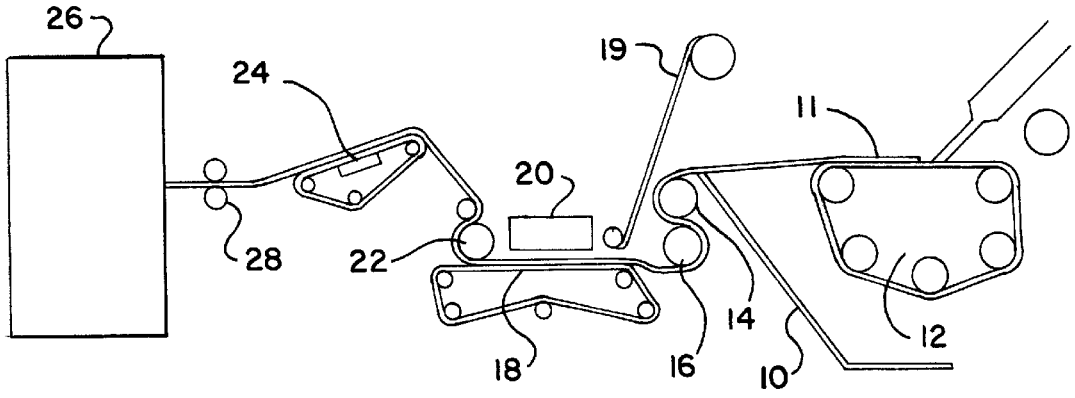
FIG. 1 is a diagrammatic view of an apparatus for making a composite nonwoven web embodying the principles of the present invention.

While the present invention is susceptible of embodiment in various forms, there is shown in the drawing, and will hereinafter be described, a presently preferred embodiment, with the understanding that the present disclosure is to be considered as an exemplification of the invention, and is not intended to limit the invention to the specific embodiment illustrated.

With reference to FIG. 1, therein is diagrammatically illustrated an apparatus for practicing the method of making a composite nonwoven fabric embodying the principles of the present invention. The present composite fabric is preferably formed from juxtaposed synthetic fiber and cellulosic fiber webs, which are subjected to hydroentanglement by direction of high-pressure liquid streams thereagainst, preferably first against one expansive surface of the juxtaposed webs and thereafter against the opposite expansive surface of the webs. It is within the purview of the present invention that each of the synthetic fiber and cellulosic fiber webs may be provided in the form of more than one web, thereby permitting the integration of different types of synthetic fibers, and/or different types of cellulosic fibers. It is also within the purview of the present invention that each of the synthetic fiber and cellulosic fiber webs may be comprised of a homogenous component composition within the web, or in the alternative, comprised of a blend of differing component compositions.

In the presently preferred practice of the present invention, the synthetic fibers are provided in the form of staple length polyester fibers, while the cellulosic fibers are provided in the form of wood pulp fibers introduced in the form of a wetlaid web, commonly referred to as "tissue", subsequently integrated by hydroentanglement with the synthetic fiber web. Notably, the present invention contemplates that the synthetic fiber web is subjected to hydroentanglement to form a partially entangled web prior to hydroentanglement of the cellulosic fiber web therewith. Formation in this fashion has been found to desirably abate loss of the cellulosic fibers during hydroentanglement with the synthetic fiber web. Additionally, pre-entanglement of the synthetic fiber web has been found to desirably permit the use of lower entangling pressures during integration of the cellulosic fiber web therewith, which is also believed to abate loss of the cellulosic fibers to the filtrate water employed during hydroentanglement.

As illustrated in FIG. 1, the present invention contemplates that the synthetic fiber web employed for manufacture of the present composite fabric include a carded or parallel staple fiber web 10 which can be combined with an airlaid synthetic fiber web 11, which can be suitably formed on an airlaying apparatus 12. The present invention contemplates that the carded and airlaid webs be juxtaposed and integrated by hydroentanglement to form a partially entangled synthetic fiber web. To this end, the carded and airlaid webs are directed about an entangling drum 14, with high-pressure liquid streams directed against the juxtaposed webs to effect integration and partial entanglement. Partial entanglement can be further effected by a second entangling drum 16, with the partially entangled synthetic fiber webs thereafter directed along an entangling belt 18.

At this stage of the process, a cellulosic fiber web 19 is juxtaposed with the partially entangled synthetic fiber web for formation of the present composite nonwoven fabric. The cellulosic fiber web is preferably provided in the form of a wetlaid web, but it is within the purview of the present invention to provide the cellulosic fibrous material in other forms. The juxtaposed synthetic fiber and cellulosic fiber webs are subjected to hydroentanglement under the influence of reduced-pressure liquid streams generated by suitable manifolds at 20 positioned above the entangling belt 18.

In accordance with the preferred practice of the present invention, the reduced-pressure liquid streams from manifold 20 are directed against a first expansive surface of the juxtaposed webs. Thereafter, the webs are directed about another entangling drum 22, with reduced-pressure liquid streams directed against the opposite expansive surface of the webs. The now integrated webs can be transferred over a dewatering slot 24, and then dried at 26 and wound for storage and shipment.

The data set forth in the accompanying Tables compares energy inputs for the present process with the energy inputs effected in accordance with the teachings of U.S. Pat. No. 5,459,912. As this data shows, the processes are similar in terms of horsepower-hour per pound energy input. However, when comparing impact energies (Hp-hr-lbf/lbm; horsepower-hour-pound force/pound mass; see U.S. Pat. No. 5,549,912, column 6, lines 3–25) of the two different processes, it is evident that the process of the present invention uses less impact energy, along with slightly higher liquid flow rates in order to achieve the desired fiber integration, while minimizing loss of the cellulosic fibers during manufacture. It is believed that the lower impact energies of the present invention result in less fiber fracture, with the higher flow rates offsetting the need for higher impact energies. Nevertheless, sufficient energy is inputted to provide the resultant nonwoven fabric with the desired physical characteristics, such as tensile strength, abrasion resistance and other desirable performance properties.

EXAMPLE

Using the apparatus as depicted in FIG. 1, a nonwoven fabric embodying the principles of the present invention was made using a 0.55 ounce/yard$^2$ of airlaid synthetic fibers, produced in accordance with methods described in U.S. Pat. Nos. 4,475,271, and 5,007,137, both hereby incorporated by reference. This airlaid synthetic web was combined with a 0.37 ounce/yard$^2$ standard carded web to form a synthetic fiber web weighing 1.0 ounce/yard$^2$ and comprising 100% polyester staple length fibers. The raw materials of these webs was commercially available 310P staple length fibers, 1.5 denier×1.5 inches in length, produced by Wellman Inc.

The airlaid and carded synthetic fiber webs were pre-entangled on drums 14 and 16 illustrated in FIG. 1, in accordance with the process conditions set forth in the appended Tables. This partially entangled synthetic web was then transferred on to the belt entangler 18. A cellulosic fiber web was provided in the form of commercially available H431XL, 31# per ream paper, commercially available from Crown Vantage, with the cellulosic fiber web thus comprising wood pulp fibers in accordance with the preferred practice of the present invention. The cellulosic fiber web was juxtaposed on top of the partially entangled synthetic fiber web, with the juxtaposed webs entangled on the entangling belt in accordance with the appended processing data.

The integrated synthetic fiber and cellulosic fiber webs were then directed about entangling drum 22, which was covered by a 22×23 bronze flat warp wire, commercially available from Albany International. Reduced-pressure liquid streams were thus directed against the opposite expansive surface of the juxtaposed webs. The water jets were operated in accordance with the data in the appended Tables.

The now-integrated web was then transferred to the dewatering belt 24, and thereafter dried in dryer 26. The nip roll 28 illustrated in FIG. 1 was not used in this example, in order to maintain high absorbency capacities for the resultant composite nonwoven fabric. Winding after drying at 26 completed fabric formation.

As will be appreciated, a fabric formed in accordance with the present invention need not be subjected to hydroentangling treatment by direction of hydraulic water jets against both expansive surfaces of the fabric as it is formed. Additionally, it will be recognized that the illustrated nip rolls can be utilized to improve fabric density, and reduce the moisture content of the web prior to drying.

From the foregoing, numerous modifications and variations can be effected without departing from the true spirit and scope of the novel concept of the present invention. It is to be understood that no limitation with respect to the specific embodiment disclosed herein is intended or should be inferred. The disclosure is intended to cover, by the appended claims, all such modifications as fall within the scope of the claims.

PGI Data:

| | Total Flow (GPM) | Hp-hr/lb | HP-Hr/lb | Hp-hr-lbf/lbm E x I |
|---|---|---|---|---|
| | 1034.1261 | 0.2302 | | |
| Preentangle | | 0.0814 | 0.0187 | 0.26705818 |
| Flatbed | | 0.5311 | 0.1223 | 3.041 |
| Drum | | 0.4689 | 0.1079 | 1.190 |
| Total | | 1.0000 | 0.2302 | 4.231 |

Example
100 YPM 110 Width (inches) estimated
2.3 OZ/YD2 Lb/hr = 2635.416667

| | | | | | | DuPont's I x E | | REQUIREMENTS PER MANIFOLD | | | | | | | |
|---|---|---|---|---|---|---|---|---|---|---|---|---|---|---|---|
| | Orifice (inches) | Pressure (psi) | # of strips | Flow | Hp-hr/lb | Hp-hr-lbf/lbm (corrected by 2.4 to match their patent values) | % energy | Orifice (inches) | Discharge Coeff. C | Pressure (psi) | Flow per hole (gpm) | No. of Holes/inch | Length of manifold (inches) | Flow total (gpm) | Motor Horsepower Required (Max = 300) |
| Drum 1 | 0.005 | 102.9 | 1 | 31.7987 | 0.0020 | 0.0026 | 10.63% | 0.005 | 0.7 | 102.9 | 0.005 | 50 | 120 | 32 | 2 |
| Drum 1 | 0.005 | 147 | 1 | 38.0067 | 0.0034 | 0.0062 | 18.15% | 0.005 | 0.7 | 147 | 0.006 | 50 | 120 | 38 | 4 |
| Drum 1 | 0.005 | 147 | 1 | 38.0067 | 0.0011 | 0.0062 | 6.05% | 0.005 | 0.7 | 147 | 0.006 | 50 | 120 | 38 | 4 |
| Drum 2 | 0.005 | 514.5 | 1 | 61.2511 | 0.0064 | 0.1062 | 34.12% | 0.005 | 0.603 | 514.5 | 0.010 | 50 | 120 | 81 | 22 |
| Drum 2 | 0.005 | 588 | 1 | 65.4802 | 0.0078 | 0.1483 | 41.89% | 0.005 | 0.603 | 588 | 0.011 | 50 | 120 | 65 | 26 |
| Preentangle Subtotal | | | | 202.7447 | 0.0187 | 0.2671 | 100.00% | | | | | | | | |
| Flatbed | 0.005 | 102.9 | 1 | 31.7987 | 0.0007 | 0.0026 | 0.54% | 0.005 | 0.7 | 102.9 | 0.005 | 50 | 120 | 32 | 2 |
| Flatbed | 0.005 | 294 | 3 | 138.9044 | 0.0083 | 0.0787 | 6.77% | 0.005 | 0.603 | 294 | 0.008 | 50 | 120 | 46 | 9 |
| Flatbed | 0.005 | 808.5 | 3 | 230.3469 | 0.0378 | 0.9865 | 30.89% | 0.005 | 0.603 | 808.5 | 0.013 | 50 | 120 | 77 | 43 |
| Flatbed | 0.005 | 808.5 | 3 | 230.3469 | 0.0378 | 0.9865 | 30.89% | 0.005 | 0.603 | 808.5 | 0.013 | 50 | 120 | 77 | 43 |
| Flatbed | 0.005 | 808.5 | 3 | 230.3469 | 0.0378 | 0.9865 | 30.89% | 0.005 | 0.603 | 808.5 | 0.013 | 50 | 120 | 77 | 43 |
| Flatbed Subtotal | | | | 861.7438 | 0.1223 | 3.0408 | 100.00% | | | | | | | | |
| Drum 3 | 0.005 | 1029 | 1 | 86.1912 | 0.0540 | 0.5950 | 50.00% | 0.005 | 0.6 | 1029 | 0.014 | 50 | 120 | 86 | 61 |
| Drum 3 | 0.005 | 1029 | 1 | 86.1912 | 0.0540 | 0.5950 | 50.00% | 0.005 | 0.6 | 1029 | 0.014 | 50 | 120 | 86 | 61 |
| Backside Subtotal | | | | 172.3823 | 0.1079 | 1.1900 | 100.00% | | | | | | | | |

| Flow for 3 strip manifold | Flow per inch for 1 strip GPM | P = lb/ft2 | A = ft2 orf Using coeff | Q = cfm Using coeff | w = lbm/yd2 | z = width-yds | S = ypm | I = PA lbf | E = PQ/wzs ft-lb/lbm |
|---|---|---|---|---|---|---|---|---|---|
| 95.39612888 | 0.795 | 14817.6 | 0.000573 | 4.251164 | 0.143750 | 3.06 | 100 | 8.486 | 1434.127 |
| 114.0201825 | 0.950 | 21168 | 0.000573 | 5.081113 | 0.143750 | 3.06 | 100 | 12.122 | 2448.729 |
| | 0.317 | 21168 | 0.000573 | 5.081113 | 0.143750 | 3.06 | 100 | 12.122 | 2448.729 |
| | 0.510 | 74088 | 0.000493 | 8.188647 | 0.143750 | 3.06 | 100 | 36.549 | 13812.173 |
| | 0.546 | 84672 | 0.000493 | 8.754032 | 0.143750 | 3.06 | 100 | 41.770 | 16875.239 |
| | | | | 27.104906 | | | | | |
| | 0.265 | 14817.6 | 0.000573 | 4.251164 | 0.143750 | 3.06 | 100 | 8.486 | 1434.127 |
| | 0.386 | 42336 | 0.000493 | 18.570107 | 0.143750 | 3.06 | 100 | 20.885 | 17898.894 |
| | 0.640 | 116424 | 0.000493 | 30.795038 | 0.143750 | 3.06 | 100 | 57.434 | 81625.382 |
| | 0.640 | 116424 | 0.000493 | 30.795038 | 0.143750 | 3.06 | 100 | 57.434 | 81625.382 |
| | 0.640 | 116424 | 0.000493 | 30.795038 | 0.143750 | 3.06 | 100 | 57.434 | 81625.382 |
| 258.573469 | 2.155 | 148176 | 0.000491 | 11.522882 | 0.143750 | 3.06 | 100 | 72.734 | 38872.363 |
| 258.573469 | 2.155 | 148176 | 0.000491 | 11.522882 | 0.143750 | 3.06 | 100 | 72.734 | 38872.363 |

DuPont Data: Total

-continued

| | Flow (GPM) | Hp-hr/lb | | |
|---|---|---|---|---|
| | 895 | 0.24 | | |
| | | | | Hp-hr-lbf/lbm |
| | | | HP-hr/lb | E x I |
| | Flatbed | 56.09% | 0.132 | 5.009 |
| | Drum | 43.91% | 0.104 | 2.103 |
| | Total | 100.00% | 0.236 | 7.111 |

DuPont Patent example #1 and #3
185 YPM 120 Width (inches) estimated
1.68 OZ/YD2 Lb/hr = 3885

| | | | | | | DuPont's I x E | | REQUIREMENTS PER MANIFOLD | | | | | | | |
|---|---|---|---|---|---|---|---|---|---|---|---|---|---|---|---|
| | Orifice (inches) | Pressure (psi) | # of strips | Flow | Hp-Hr/lb | Hp-hr-lbf/lbm (corrected by 2.4 to match their patent values) | % energy | Orifice (inches) | Discharge Coeff. C | Pressure (psi) | Flow per hole (gpm) | No. of Holes/inch | Length of manifold (inches) | Flow total (gpm) | Motor Horsepower Required |
| Flatbed | 0.005 | 50 | calculation | 0 | 0 | 0 | 0.00% | 0.005 | | 50 | 0.000 | 40 | 120 | 0 | 0 |
| Flatbed | 0.005 | 100 | 1 | 25.0779 | 0.0011 | 0.0010 | 0.85% | 0.005 | 0.7 | 100 | 0.005 | 40 | 120 | 25 | 2 |
| Flatbed | 0.005 | 300 | 1 | 37.4172 | 0.0017 | 0.0120 | 1.27% | 0.005 | 0.603 | 300 | 0.008 | 40 | 120 | 37 | 8 |
| Flatbed | 0.005 | 500 | 1 | 48.3054 | 0.0036 | 0.0429 | 2.74% | 0.005 | 0.603 | 500 | 0.010 | 40 | 120 | 48 | 17 |
| Flatbed | 0.005 | 800 | 1 | 61.1021 | 0.0073 | 0.1390 | 5.54% | 0.005 | 0.603 | 800 | 0.013 | 40 | 120 | 61 | 34 |
| Flatbed | 0.005 | 1400 | 1 | 80.8305 | 0.0170 | 0.5633 | 12.83% | 0.005 | 0.603 | 1400 | 0.017 | 40 | 120 | 81 | 78 |
| Flatbed | 0.005 | 1800 | 1 | 91.6531 | 0.0248 | 1.0559 | 18.71% | 0.005 | 0.603 | 1800 | 0.019 | 40 | 120 | 92 | 113 |
| Flatbed | 0.005 | 1800 | 1 | 91.6531 | 0.0248 | 1.0559 | 18.71% | 0.005 | 0.603 | 1800 | 0.019 | 40 | 120 | 92 | 113 |
| Flatbed | 0.005 | 1800 | 1 | 91.6531 | 0.0248 | 1.0559 | 18.71% | 0.005 | 0.603 | 1800 | 0.019 | 40 | 120 | 92 | 113 |
| Flatbed | 0.005 | 1800 | 1 | 91.6531 | 0.0248 | 1.0559 | 18.71% | 0.005 | 0.603 | 1800 | 0.019 | 40 | 120 | 92 | 113 |
| Flatbed | 0.005 | 300 | 1 | 56.1259 | 0.0025 | 0.0269 | 1.91% | 0.005 | 0.603 | 300 | 0.008 | 60 | 120 | 56 | 12 |
| | Flatbed Subtotal | | | 675.4716 | 0.1323 | 5.0088 | 100.00% | | | | | | | | |
| Drum | 0.005 | 300 | 1 | 37.2311 | 0.0050 | 0.0119 | 4.86% | 0.005 | 0.6 | 300 | 0.008 | 40 | 120 | 37 | 8 |
| Drum | 0.005 | 1800 | 1 | 91.1971 | 0.0739 | 1.0454 | 71.36% | 0.005 | 0.6 | 1800 | 0.019 | 40 | 120 | 91 | 113 |
| Drum | 0.005 | 1800 | 1 | 91.1971 | 0.0246 | 1.0454 | 23.79% | 0.005 | 0.6 | 1800 | 0.019 | 40 | 120 | 91 | 113 |
| | Backside Subtotal | | | 219.6254 | 0.1036 | 2.1026 | 100.00% | | | | | | | | |

| Flow for 3 strip manifold | Flow per inch for 1 strip GPM | P = lb/ft2 | A = ft2 orf Using coeff | Q = cfm Using coeff | w = lbm/yd2 | z = width-yds | S = ypm | I = PA lbf | E = PQ/wzs ft-lbf/lbm |
|---|---|---|---|---|---|---|---|---|---|
| 0 | 0 | 7200 | 0 | 0 | 0.105 | 3.333333333 | 185 | 0 | 0 |
| 75.23360918 | 0.62694841 | 14400 | 0.00045814 | 3.35266529 | 0.105 | 3.333333333 | 185 | 6.59715 | 745.61205 |
| | 0.31181029 | 43200 | 0.00039465 | 5.0023042 | 0.105 | 3.333333333 | 185 | 17.089205 | 3337.44465 |
| | 0.40254536 | 72000 | 0.00039465 | 6.45794695 | 0.105 | 3.333333333 | 185 | 28.4148675 | 7181.03753 |
| | 0.50918408 | 115200 | 0.00039465 | 8.16872855 | 0.105 | 3.333333333 | 185 | 45.463788 | 14533.3981 |
| | 0.67358722 | 201600 | 0.00039465 | 10.8062121 | 0.105 | 3.333333333 | 185 | 79.561629 | 33645.2875 |
| | 0.76377612 | 259200 | 0.00039465 | 12.2530928 | 0.105 | 3.333333333 | 185 | 102.293523 | 49050.2187 |
| | 0.76377612 | 259200 | 0.00039465 | 12.2530928 | 0.105 | 3.333333333 | 185 | 102.293523 | 49050.2187 |
| | 0.76377612 | 259200 | 0.00039465 | 12.2530928 | 0.105 | 3.333333333 | 185 | 102.293523 | 49050.2187 |
| | 0.76377612 | 259200 | 0.00039465 | 12.2530928 | 0.105 | 3.333333333 | 185 | 102.293523 | 49050.2187 |
| | 0.46771544 | 43200 | 0.00059198 | 7.50345829 | 0.105 | 3.333333333 | 185 | 25.5733808 | 5006.16698 |
| 111.69324 | 0.930777 | 43200 | 0.00039269 | 4.97741711 | 0.105 | 3.333333333 | 185 | 16.9641 | 3320.84045 |
| 273.5914456 | 2.27992871 | 259200 | 0.00039269 | 12.1921322 | 0.105 | 3.333333333 | 185 | 101.7846 | 48806.1877 |
| | 0.75997624 | 259200 | 0.00039269 | 12.1921322 | 0.105 | 3.333333333 | 185 | 101.7846 | 48806.1877 |

What is claimed is:

1. A method of making a composite nonwoven fabric, comprising the steps of:

providing a synthetic fiber web comprising staple length polymeric fibers;

hydroentangling said synthetic fiber web to form a partially entangled web;

juxtaposing a cellulosic fiber web with said partially entangled web;

hydroentangling said juxtaposed partially entangled web and cellulosic fiber web; and drying said hydroentangled webs to form said composite nonwoven fabric.

2. A method of making a composite nonwoven fabric in accordance with claim 1, wherein:

said step of providing said synthetic fiber web comprises providing an airlaid synthetic fiber web and a carded synthetic fiber web which are hydroentangled to form said partially entangled web.

3. A method of making a composite nonwoven fabric in accordance with claim 1, wherein:

said synthetic fiber web comprises staple length polyester fibers, and said cellulosic fiber web comprises wood pulp fibers.

4. A method of making a composite nonwoven fabric in accordance with claim 1, wherein said step of hydroentangling said juxtaposed webs comprises first directing reduced-pressure liquid streams against a first expansive surface of said juxtaposed webs, and thereafter directing reduced-pressure liquid streams against an opposite expansive surface of said juxtaposed web.

5. A composite nonwoven fabric formed in accordance with the method of claim 1.

6. A method of making a composite nonwoven fabric, comprising the steps of:

providing a synthetic fiber web by juxtaposing an airlaid staple length polyester fiber web and a carded staple length polyester fiber web;

hydroentangling said synthetic fiber web by hydroentangling said juxtaposed airlaid and carded webs to form a partially entangled synthetic fiber web, juxtaposing a paper web comprising wood pulp fibers with said partially entangled web;

hydroentangling said juxtaposed partially entangled web and said paper web to integrate wood pulp fiber of said paper web with the polyester staple length fibers of said partially entangled web; and drying said hydroentangled webs to form said composite nonwoven fabric.

7. A method of making a composite nonwoven fabric in accordance with claim 6, wherein:

said step of hydroentangling said juxtaposed partially entangled web and paper web comprises first directing high-pressure liquid streams against a first expansive surface of the juxtaposed webs, and thereafter directing high-pressure liquid streams against an opposite expansive surface of said juxtaposed web.

8. A method of making a composite nonwoven fabric in accordance with claim 6, wherein:

said airlaid web comprises 100% polyester fibers.

9. A method of making a composite nonwoven fabric in accordance with claim 6, wherein:

said carded web comprises 100% polyester fibers.

10. A composite nonwoven fabric formed in accordance with the method of claim 6.

* * * * *